US007513471B2

(12) United States Patent
Moufflet

(10) Patent No.: US 7,513,471 B2
(45) Date of Patent: Apr. 7, 2009

(54) DEVICE FOR FIXING AN OBJECT ON A VERTICAL ROD

(75) Inventor: Claude Moufflet, Saint Lambert des Bois (FR)

(73) Assignee: Mobile Cables System, Ardentes (FR)

( * ) Notice: Subject to any disclaimer, the term of this patent is extended or adjusted under 35 U.S.C. 154(b) by 368 days.

(21) Appl. No.: 10/520,476

(22) PCT Filed: Jun. 26, 2003

(86) PCT No.: PCT/FR03/01976

§ 371 (c)(1),
(2), (4) Date: Sep. 15, 2005

(87) PCT Pub. No.: WO2004/003395

PCT Pub. Date: Jan. 8, 2004

(65) Prior Publication Data

US 2006/0165483 A1 Jul. 27, 2006

(30) Foreign Application Priority Data

Jul. 1, 2002 (FR) ..... 02 08201

(51) Int. Cl.

| | |
|---|---|
| ***A47B 96/06*** | (2006.01) |
| ***A47G 29/00*** | (2006.01) |
| ***A47K 1/00*** | (2006.01) |
| ***E04G 5/06*** | (2006.01) |
| ***F21V 21/00*** | (2006.01) |

(52) U.S. Cl. ..... 248/218.4; 248/219.2

(58) Field of Classification Search ..... 248/218.4, 248/219.2, 219.4, 230.7, 245, 241, 230.5, 248/214

See application file for complete search history.

(56) References Cited

U.S. PATENT DOCUMENTS

| | | | | |
|---|---|---|---|---|
| 3,809,338 | A * | 5/1974 | Gross et al. | 244/1 R |
| 4,582,001 | A * | 4/1986 | Leikarts | 108/106 |
| 4,615,278 | A * | 10/1986 | Cabrelli | 108/192 |
| 4,750,626 | A * | 6/1988 | Nicely | 211/187 |
| 5,277,391 | A * | 1/1994 | Haug et al. | 248/219.3 |
| 5,641,141 | A * | 6/1997 | Goodwin | 248/218.4 |
| 5,867,132 | A * | 2/1999 | Blasing et al. | 343/890 |
| 6,250,596 | B1 * | 6/2001 | Gordin et al. | 248/230.1 |
| 6,283,425 | B1 * | 9/2001 | Liljevik | 248/230.4 |
| 6,948,689 | B2 * | 9/2005 | Kenney | 248/218.4 |
| 2002/0096610 | A1 * | 7/2002 | Fernandez | 248/218.4 |

FOREIGN PATENT DOCUMENTS

| | | |
|---|---|---|
| EP | 0389864 | 3/1990 |
| FR | 1351079 | 3/1963 |
| FR | 1562272 | 4/1969 |
| FR | 2407691 | 11/1977 |
| FR | 2790047 | 2/1999 |
| GB | 772272 | 4/1957 |

* cited by examiner

*Primary Examiner*—Amy J. Sterling
(74) *Attorney, Agent, or Firm*—Blakely, Sokoloff, Taylor & Zafman LLP

(57) ABSTRACT

The article (37) is fastened to the rod (1), and the rod is fastened to a support such as a ceiling or a wall, by fastener means each comprising two parts (4, 19) that lock together around the rod.

18 Claims, 3 Drawing Sheets

F1
1
1a
2
3
3a-1
3a-2
4
5
6
7
8
9
10
11
12
13
14
15
16
19
20
21
22
23
24
25
26
27
28
29
30
35
36
37
38
39
40
P

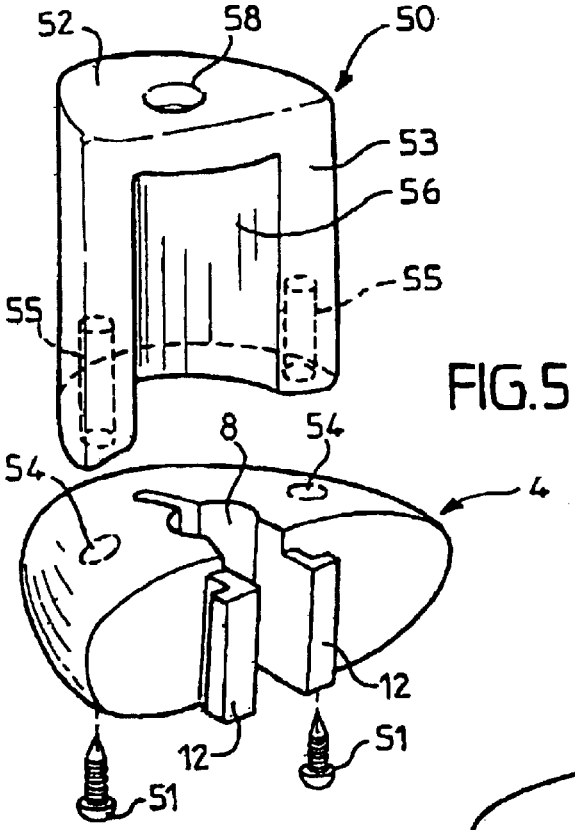
FIG.5
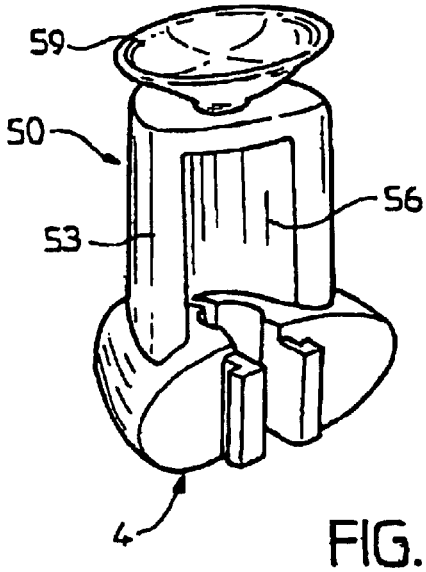
FIG.6
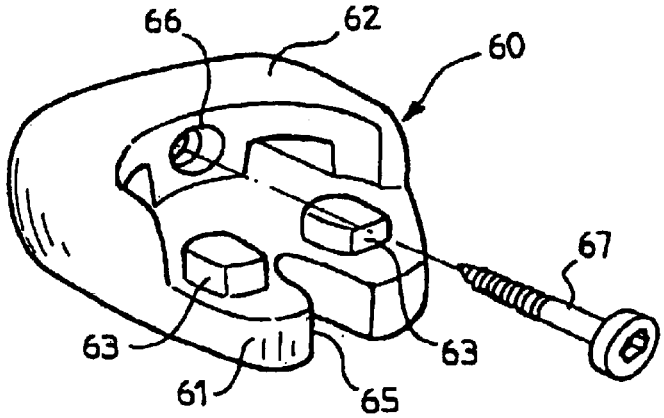
FIG.8
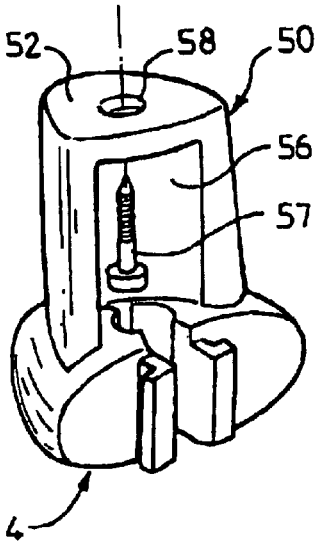
FIG.7
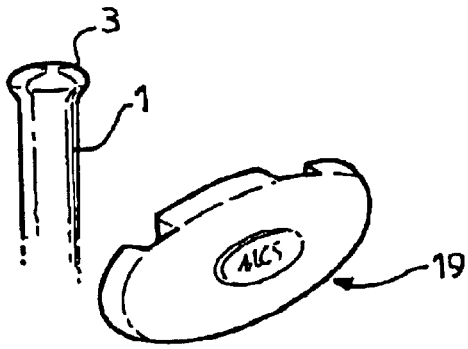

DEVICE FOR FIXING AN OBJECT ON A VERTICAL ROD

The present patent application is a non-provisional application of International Application No. PCT/FR2003/001976, filed Jun. 26, 2003.

The invention relates to a device for fastening an article to a primary support such as a wall in premises, the device comprising a rod having a cylindrical body, and at least a first fastener arrangement for fastening the article to the body of the rod in releasable manner and in a position that is adjustable along the rod.

Such a device is known from FR 2 207 691 A, for example.

That known device comprises a multiplicity of metal parts for fastening a metal rod to a first primary support constituted by a ceiling, a multiplicity of metal parts for fastening the rod to a second primary support constituted by the floor, and still more parts for fastening the article to the rod, all of the parts being different from one another and the parts for fastening the article to the rod differing from one another depending on the nature of the article to be fastened. Putting the rod into place, and putting the article into place on the rod involves screw fastening operations.

The object of the invention is to make the manufacture and the use of the device simpler and less expensive.

The invention provides in particular a device of the kind defined in the introduction, and provides for the first fastener arrangement to comprise a first assembly part presenting two branches suitable for placing on either side of the body in such a manner as to hold the first assembly part in place on the body by friction, with it being possible for the part to be slid manually in a longitudinal direction to a selected position along the body, and a second assembly part suitable for being secured to the first assembly part with said branches being clamped against the body in such a manner as to lock the first assembly part in said selected position.

Optional characteristics of the invention that can be used in addition or in substitution are specified below:

- the device further comprises a second fastener arrangement for fastening the rod to the primary support in a vertical orientation, the second fastener arrangement comprising a first assembly part having two branches suitable for placing on either side of the body in such a manner as to hold the first assembly part in place on the body by friction, and a second assembly part suitable for being secured to the first assembly part with said branches being clamped onto the body in such a manner as lock the first assembly part in position
- the rod presents a head at its top end that is of section greater than that of the body and/or that is axially offset relative to the body, and that is suitable for pressing against the second fastener arrangement to enable the rod to be suspended freely therefrom;
- the head is integrally formed with the body;
- the first assembly part of the first fastener arrangement and the first assembly part of the second fastener arrangement are interchangeable;
- the second assembly part of the first fastener arrangement and the second assembly part of the second fastener arrangement are interchangeable;
- the device further comprises a secondary support for connecting the second fastener arrangement to a primary support in the form of a substantially horizontal top wall, said secondary support being fastened by screws to the top of the first assembly part and presenting at its own top means for fastening to the primary support;

- the device further comprises a secondary support for connecting the second fastener arrangement to a primary support in the form of a substantially vertical wall, said secondary support presenting means for fastening to the primary support, said secondary support and the first assembly part presenting co-operating shapes enabling the assembly part to be supported in stable manner by the support;
- the second assembly part presses the body against the end of a notch defined by the two branches;
- the first and second assembly parts present mutual guide elements for guiding movement of the second part relative to the first, downwards parallel to the longitudinal direction of the body, to a final abutment position in which the clamping of said branches against the body is obtained;
- the first and second assembly parts present respective ramps which transform said downward movement into movement in which said branches move towards each other;
- the first fastener arrangement presents at least one upwardly-open hole for receiving a downwardly-directed toe formed on an article for fastening;
- said hole passes downwards through the first arrangement;
- said hole is defined by a notch formed in the second assembly part and by a plane surface of the first assembly part;
- the first fastener arrangement presents two holes that are symmetrical to each other about a vertical plane in common with said branches so as to receive respective toes formed on two articles for fastening on either side of the arrangement;
- the second assembly part of the first fastener arrangement presents a hook opposite from its first face for the purpose of supporting an article for fastening;
- the second assembly part of the first fastener arrangement presents two through vertical holes opposite from the first part for the purpose of fastening a lighting appliance; and
- all or some of the components constituted by the rod, the assembly parts, and where appropriate the secondary support, are made of plastics material.

The characteristics and advantages of the invention are set out in greater detail in the following description given with reference to the accompanying drawings.

FIG. 5 is an exploded perspective view showing how the first assembly part of the second fastener arrangement of a device of the invention is fastened to a secondary support for fastening to a ceiling.

FIG. 6 is a perspective view showing the same assembly once assembled together, the secondary support being provided with a suction cup.

FIG. 7 is an exploded perspective view showing the rod and the second fastener arrangement of a device of the invention, the first assembly part being fastened on a secondary support similar to that of FIG. 5.

FIG. 8 is a perspective view of a secondary support for fastening to a wall.

In the present description, the terms "top" and "bottom" refer to the orientation of the device when it is installed, the rod being suspended substantially vertically from the second fastener arrangement, and the terms "front" and "rear" as applied to a fastener arrangement make sense only after assembly, with the secondary assembly part of the arrangement being situated in front of the first assembly part.

Figures 1, 2, 3, 4:
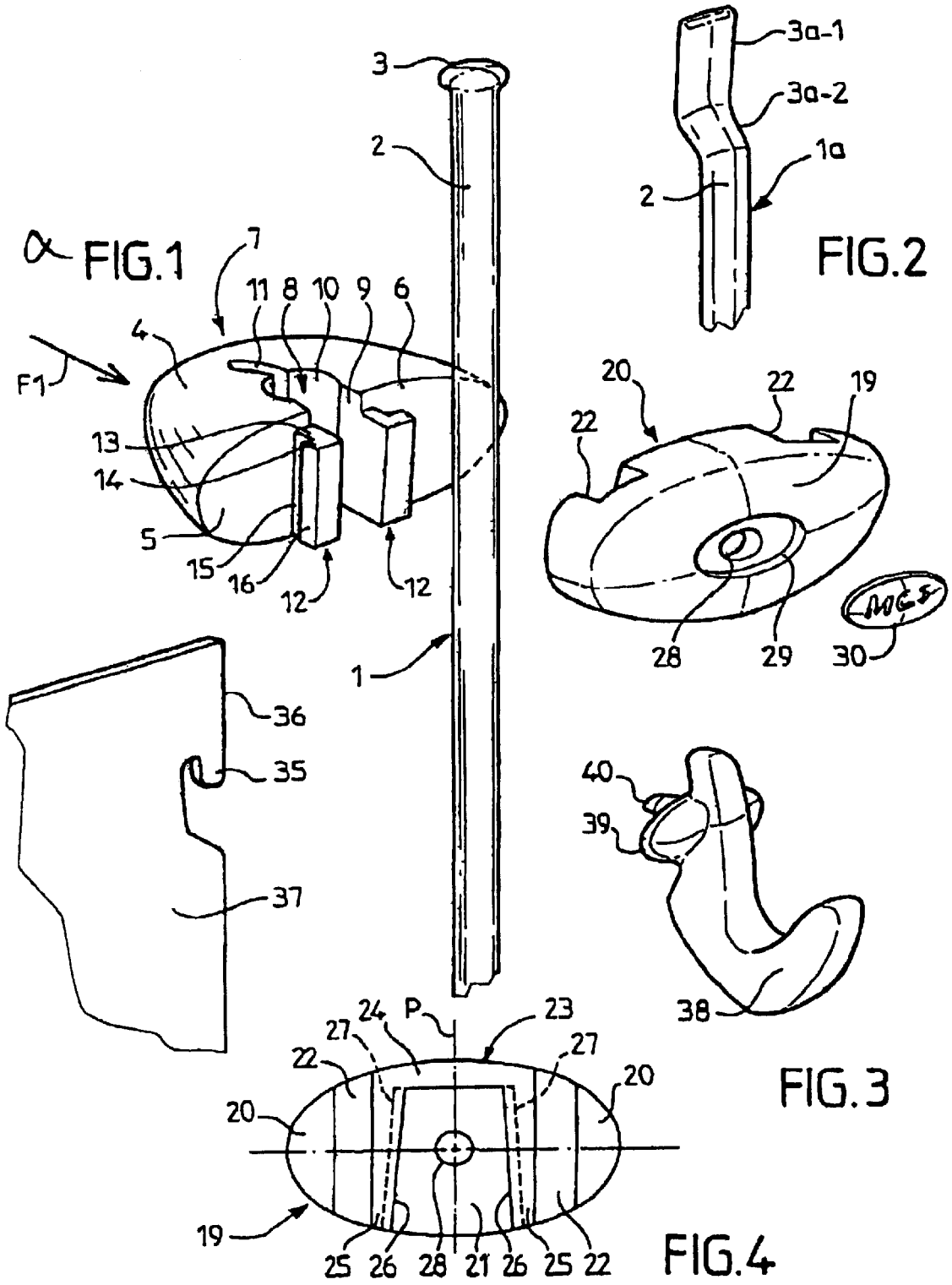
FIG. 1 is an exploded fragmentary perspective view showing the rod of a device of the invention, a first fastener arrangement, and an article for fastening by means thereof.
FIG. 2 is a fragmentary perspective view of a variant of the rod.
FIG. 3 is a perspective view of a hook suitable for fitting to the second assembly part of the first fastener arrangement.
FIG. 4 is an elevation view of the second assembly part.

The rod 1 shown in FIG. 1 is made by extruding a transparent plastics material such as polycarbonate, or an opaque plastics material such as an acrylonitrile-butadiene-styrene copolymer. It possesses a cylindrical body 2, e.g. having a diameter of 6 millimeters (mm) that is obtained directly by extrusion. At its top end, the body 2 is connected to a head 3 of greater diameter than the body, formed by hot flattening.

FIG. 1 also shows a first assembly part 4 which, like the other assembly parts and the secondary support described below, is made by injection-molding a plastics material, for example polyoxymethylene. The part 4 presents a vertical plane surface 5 that, in the example shown, possesses an outline 6 that is substantially elliptical, having a major axis that is horizontal. The section of the part 4 on a plane parallel to the surface 5 presents an outline that is substantially elliptical with its major axis and minor axis decreasing progressively as the section plane is moved rearwards, becoming zero at the rear end 7 of the part so as to give it a substantially ovoid shape. A notch 8 is formed in the part 4 over its full height, from the surface 5 and symmetrically on either side of a vertical plane of symmetry of the above-mentioned elliptical profile, referenced P in FIG. 4. The notch 8 is cylindrical in shape with vertical generator lines. A first region 9 of the notch 8, adjacent to the surface 5, is of width that is slightly smaller than the diameter of the body 2 of the rod. The region 9 is connected to a region 10 that is further away from the surface 5 and of outline that is substantially circular in shape and of diameter substantially equal to that of the body 2. Beyond the region 9, the notch 8 is extended by a narrow slot 11 extending in the plane of symmetry P. Two vertically elongate tabs 12 are formed projecting from the surface 5 so as to define between them an extension of the region 9 of the notch 8. Each tab 12 extends over a major fraction of the height of the part 4 and presents an L-shaped profile comprising a first limb 13 adjacent to the surface 5 and extending parallel to the plane P, and a second limb 14 following the limb 13 and extending at right angles away from the plane P. The faces 15 and 16 of the limbs 13 and 14 facing away from the plane P slope slightly so that they become slightly further away therefrom on going downwards.

FIG. 1 also shows a second assembly part 19 that can also be seen in FIG. 4. The part 19 possesses a plane surface 20 having the same elliptical outline as the surface 5 of the part 4, and its section on a plane parallel to the surface 20 presents an outline that is substantially elliptical with the major axis and the minor axis thereof decreasing progressively as the section plane is moved forwards. A middle housing 21 and two downwardly-extending grooves 22 are formed starting from the surface 20, symmetrically on either side of the plane P. The housing 21 and the grooves 22 define an upside-down U-shaped connection structure 23 having a cross-piece 24 that extends horizontally along the top surface of the part 19 and two branches 25 that extend substantially vertically, each between the housing 21 and one of the grooves 22. The branches 25 present an inside profile complementary to the outside profile of the tabs 12 of the part 4, with sloping surfaces 26 and 27 suitable for co-operating with the sloping surfaces 15 and 16 of the tabs 12. A through hole 28 is formed horizontally in the part 19 in the center of the elliptical profile thereof, and it becomes enlarged in an elliptical setback 29 in the vicinity of the rounded front face of the part. A pellet 30 having the same shape as the setback 29 can be inserted therein in order to mask the hole 28 when it is not being used for fastening an accessory.

When the rod 2 is fastened via its top end to a primary support such as a ceiling or a wall, and as described below, the fastener arrangement can be put into place as follows. The part 4 is initially moved horizontally relative to the rod along arrow F1 in FIG. 1 so that the body 2 engages between the tabs 12, and then in the notch 8, causing the two branches formed by the tabs 12 and by the portions of the part 4 that are situated on either side of the notch and the slot 11 to splay apart elastically. When the body 2 reaches the enlarged portion 10, the two branches move towards each other so as to enclose the body 2 tightly and prevent it from moving relative to the part 4, with movement in translation along the body then being possible only by exerting manual force on the part 4.

To mount the part 19 on the part 4, the part 19 is placed so that its plane surface 20 lies substantially in the same plane as the surface 5 of the part 4 and immediately above it, after which the part 19 is lowered so as to cause the surface 20 to slide on the surface 4. The branches 25 of the structure 23 co-operate with the tabs 12 in order to hold the surfaces 5 and 20 pressed against each other, with the sloping surfaces 26, 27 of the branches 25 moving along the sloping surfaces 15, 16 of the tabs 12. Because these surfaces are sloping, a clamping force is progressively exerted on the tabs 12, and consequently on the sides of the notch 8 to which they are connected, with the body 2 of the rod being tightly clamped between the cylindrical surface portions 10 of the notch so as to hold the part 4 firmly stationary relative on the body 2. Movement of the part 19 stops when the cross-piece 24 of the structure 23 comes to bear on the top ends of the tabs 12. The elliptical outline of the surface 20 then coincides with the elliptical outline of the surface 5, the outside surface of the part 19 running in continuity with the outside surface of the part 4.

When the parts 4 and 19 are in the assembled state, the grooves 22 in the part 19 are closed beside the part 4 by the surface 5, thus forming vertical through chimneys of rectangular cross-section. A toe 35 formed in the vertical edge 36 of a display panel 37 can be engaged downwards in each of the chimneys. The vertical edge of the panel 37 that is opposite from the edge 36 and not shown presents a toe similar to the toe 35 suitable for being engaged in the same manner in a chimney of a fastener arrangement similar to that formed by the parts 4 and 19 and fastened in the same manner on another vertical rod, for the purpose of fastening the panel.

In addition, the pellet 30 can be replaced by a hook 38 as shown in FIG. 3 provided with a base 39 suitable for filling the setback 29, a peg 40 projecting from the base 39 and snap-fastening in the hole 28 to secure the hook 38, which can then be used to hang an article such as a picture.

Parts 4 and 19 identical to those described above and forming a first fastener arrangement for fastening an article on the body of the rod can be used to form a second fastener arrangement for fastening the rod to a primary support. Thus, in FIGS. 5 to 7, a second fastener arrangement 4, 19 serves to fasten the rod 1 to a ceiling (not shown) via a secondary support 5, itself fastened to the part 4 by screws 51. The support 50 is a single part defining a top horizontal plate 52 and a half-skirt extending downwards from a portion of the periphery of the plate 52 to rest on the top of the part 4. The screws 51 engage substantially vertically upwards in holes 54 in the part 4 and are screwed into threaded holes 55 in the half-skirt 53, the screws being symmetrical to each other about the plane P. Advantageously, the holes 54 are prepared during molding of the part, but without opening out into the top thereof so as to remain invisible so long as they are not used, and the film of material closing off the end of each hole is broken under pressure from the screw 51. A cavity 56 that is open towards the front and closed downwards by the part 4, upwards by the plate 52, and rearwards and sideways by the half-skirt 53 serves to hold the head 3 of the rod and enables a fastening screw 57 (FIG. 7) to be inserted for engaging in a hole 58 passing through the plate 52 in order to screw into the ceiling. In the variant of FIG. 6, the fastening to the ceiling is provided by a suction cup 59 which is engaged in the hole 58.

Figure 9:
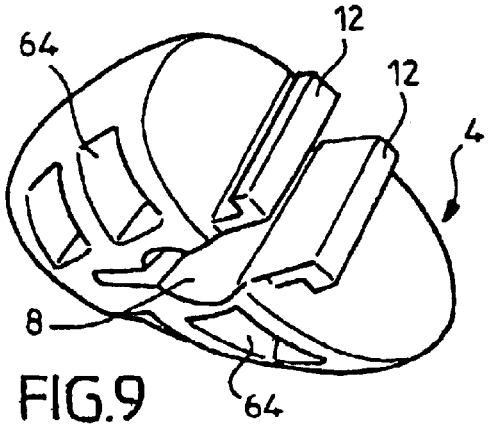
FIG. 9 is a perspective view from beneath of a first assembly part designed to co-operate with the support of FIG. 8.
Figure 10:
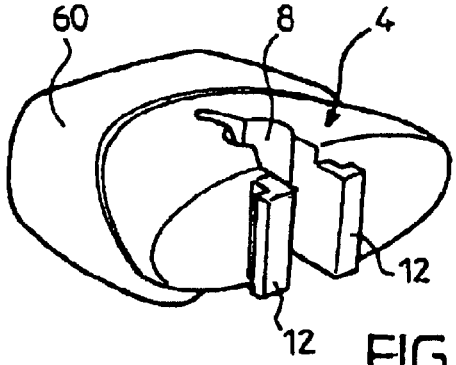
FIG. 10 is a perspective view showing the FIG. 9 assembly part fitted on the support of FIG. 8.
Figure 11:
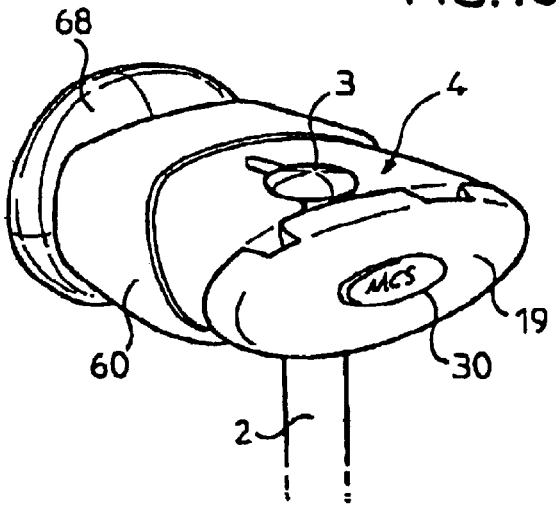
FIG. 11 is a view analogous to FIG. 10, showing in addition a rod, a second assembly part associated with the first assembly part, and a suction cup for fastening the assembly to vertical glazing.

In FIGS. 10 and 11, the same parts 4 and 19 are associated with another part 60 show on its own in FIG. 8 that serves a secondary support for fastening the device to a vertical wall (not shown). The support 60 comprises a base 61 for supporting the part 4 and a rim 62 extending upwards from about half of the rear portion of the periphery of the base in order to surround the part 4 in part. The top face of the base 61 presents projections. 63 which co-operate with recesses 64 (FIG. 9) formed in the underside of the part 4 to enable it to be positioned stably. The prepared holes 54 mentioned with reference to FIG. 5 are advantageously formed starting from the recesses 64. A notch 65 is formed in the base 61 to pass the rod 1. The rim 62 is pierced by a hole 66 of horizontal axis lying in the plane of symmetry P, to pass a screw 67 for fastening the part 60 and via said part the fastener arrangement 4-19 to a vertical wall. In a variant, and as shown in FIG. 11, the hole 66 can receive a suction cup 67 similar to the suction cup 59 for fastening the device to a shop window.

Figure 12:
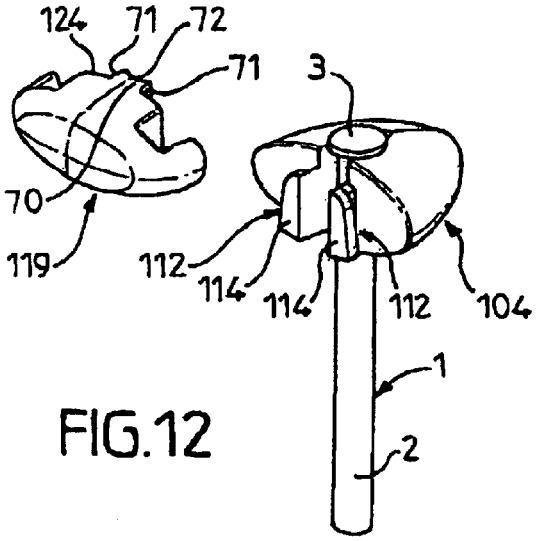
FIG. 12 is an exploded perspective view showing a rod and a second fastener arrangement slightly modified compared with those of the preceding figures.
Figure 14:
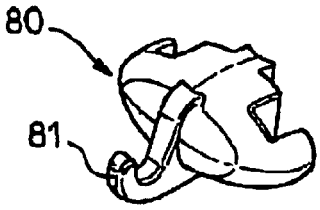
FIGS. 14 and 15 are perspective views of second assembly parts for different first fastener arrangements.
Figure 13:
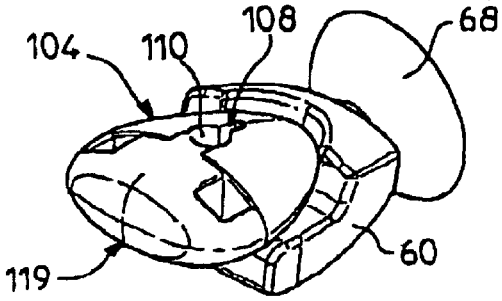
FIG. 13 is a perspective view showing the second fastener arrangement of FIG. 12 associated with a secondary support provided with a suction cup for fastening to vertical glazing.

FIGS. 12 and 13 show a rod 1, a secondary support 60, and a suction cup 67 similar to the corresponding elements in FIG. 11, and parts 104 and 119 that are somewhat modified compared with the above-described parts 4 and 19, the component elements of the parts 104 and 119 being given the same reference numerals as the corresponding elements of the parts 4 and 19, plus 100. The part 104 differs slightly from the part 4 in the shape of the limbs 114 of the tabs 112, but without changing their function.

The cross-piece 124 of the connection structure of the part 119 carries a tenon 70 for engaging in the region 109 of the notch 108 in the part 104, and for this purpose it presents plane and vertical side faces 71 suitable for pressing against the faces of the region 109. The free end 72 of the tenon 70 presses the body 2 of the rod 1 against the end wall of the notch 108 and presents concave curvature so as to complete the region 110 of the notch so that it closely surrounds the body over the major fraction of its circumference when the parts 104 and 119 are assembled around it. The hole 28 and the setback 29 are omitted from the part 119 so it is not possible to fix the hook 38 of FIG. 3 thereto. Instead, a part 80 is provided that differs from the part 119 in that it has a hook-shaped projection 81 formed at its front end and which is therefore suitable for use in combination with the part 104 to replace the set of parts 4, 19, and 38.

Figure 15:
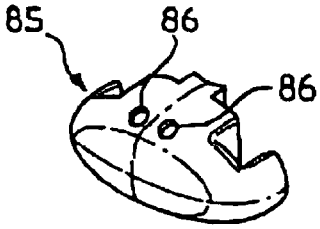

Similarly, FIG. 15 shows a part 85 which differs from the part 119 by the presence of two through vertical holes 86 in the vicinity of its front end, suitable for fastening a lighting appliance.

As a replacement for the rod 1 of FIG. 1, it is possible to use the rod that is shown in part in FIG. 2 which comprises a body 2 similar to that of the rod 1 and a head formed by a vertical end segment **3*a*-1 and a sloping connection segment 3*a*-2 connecting the segment 3*a*-1 to the body 2, with it being possible to obtain this head, like the head 3, by hot-deformation of the extruded rod, with it being possible for this head likewise to press against the top of the part 4. The rod 1*a*** presents the advantage of being usable not only with a second fastener arrangement as described above, but also with a horizontal rail to form a rail molding as described in FR 2 790 047 A.

The above description is not limiting in any way. In particular, the parts of the device can be modified without going beyond the ambit of the invention in order to adapt them to primary supports and/or articles for fastening that are different from those mentioned. The assembly parts can be connected together by profiles other than the L-shaped profile of the tabs 12 and the corresponding profile of the branches 25, for example the profile could be dovetail-shaped. Snap-fastening means may be provided to make the assembled position of the parts more stable, e.g. in the form of pegs on one of the parts co-operating with cavities in the other part. A single secondary support can be provided with means enabling it to be fastened either to a horizontal primary support or to a vertical primary support. A first assembly part and a secondary support may be combined to form a single part.

The invention claimed is:

1. A device for fastening an article (37) to a ceiling or a wall, the device comprising a rod (1) having a cylindrical body (2) and at least a first fastener arrangement (4, 19) for fastening the article to the body of the rod in releasable manner and in a position that is adjustable along the rod, wherein the first fastener arrangement comprises:

a first assembly part (4) in which a notch (8) is formed, the first assembly part presenting two tabs (12) formed projecting and defining between them an extension of the notch (8), the notch extending by a slot (11) on the side opposite to the tabs (12), the tabs and the portions of the assembly part (4) that are situated on either side of the notch (8) and the slot (11) forming two branches suitable for being splayed apart elastically and placing on either side of the body in such a manner as to hold the first assembly part in place on the body by friction, with it being possible for the part to be slid manually in a longitudinal direction to a selected position along the body, and a second assembly part (19) suitable for being secured to the first assembly part with said branches being clamped against the body in such a manner as to lock the first assembly part in said selected position, in which the first and second assembly parts present mutual guide elements (12, 25) for guiding movement of the second part relative to the first, downwards parallel to the longitudinal direction of the body, to a final abutment position in which the clamping of said branches against the body is obtained.

2. A device according to claim 1, further comprising a second fastener arrangement for fastening the rod (1) to the ceiling or wall in a vertical orientation, the second fastener arrangement comprising a first assembly part having two branches suitable for placing on either side of the body (2) in such a manner as to hold the first assembly part in place on the body by friction, and a second assembly part suitable for being secured to the first assembly part with said branches being clamped onto the body in such a manner as lock the first assembly part in position.

3. A device according to claim 2, in which the rod (1) presents a head (3) at its top end that is of section greater than that of the body (2) and/or that is axially offset relative to the body, and that is suitable for pressing against the second fastener arrangement to enable the rod to be suspended freely therefrom.

4. A device according to claim 3, in which the head (3) is integrally formed with the body (2).

5. A device according to claim 2, in which the first assembly part (4) of the first fastener arrangement and the first assembly part (4) of the second fastener arrangement are interchangeable.

6. A device according to claim 2, in which the second assembly part (19) of the first fastener arrangement and the second assembly part of the second fastener arrangement are interchangeable.

7. A device according to claim 2, further comprising a secondary support (50) for connecting the second fastener arrangement to the ceiling or wall in the form of a substantially horizontal top wall, said secondary support being fastened by screws (51) to the top of the first assembly part (4) and presenting at its own top means (52, 58) for fastening to the ceiling or wall.

8. A device according to claim 2, further comprising a secondary support (60) for connecting the second fastener arrangement to the ceiling or wall in the form of a substantially vertical wall, said secondary support presenting means (62, 66) for fastening to the ceiling or wall, said secondary support and the first assembly part (4) presenting co-operating shapes enabling the assembly part to be supported in stable manner by the support.

9. A device according to claim 7 or claim 8, in which said means comprise a face (52) that is respectively substantially horizontal or vertical, pierced by a hole (58, 66) for passing a screw (57, 67) or a suction cup (59, 68).

10. A device according to claim 1, in which the second assembly part presses the body (2) against the end of the notch defined by the two branches.

11. A device according to claim 1, in which the first and second assembly parts present respective ramps (15, 16, 26, 27) which transform said downward movement into movement in which said branches move towards each other.

12. A device according to claim 1, in which the first fastener arrangement (4, 19) presents at least one upwardly-open hole (22) for receiving a downwardly-directed toe (35) formed on an article (37) for fastening.

13. A device according to claim 12, in which said hole (37) passes downwards through the first arrangement (4, 19).

14. A device according to claim 12 or claim 13, in which said hole is defined by a notch (22) formed in the second assembly part (19) and by a plane surface (5) of the first assembly part (54).

15. A device according to claim 12, in which the first fastener arrangement presents two holes (22) that are symmetrical to each other about a vertical plane (P) in common with said branches so as to receive respective toes (35) formed on two articles (37) for fastening on either side of the arrangement.

16. A device according to claim 1, in which the second assembly part (80) of the first fastener arrangement (104, 80) presents a hook opposite from its first face (81) for the purpose of supporting an article for fastening.

17. A device according to claim 1, in which the second assembly part (85) of the first fastener arrangement (104, 85) presents two through vertical holes (86) opposite from the first part for the purpose of fastening a lighting appliance.

18. A device according to claim 1 or claim 7 or claim 8, in which all or some of the components constituted by the rod, the assembly parts, and where appropriate the secondary support, are made of plastics material.

* * * * *